US006622310B1

(12) United States Patent
Tsai

(10) Patent No.: US 6,622,310 B1
(45) Date of Patent: Sep. 23, 2003

(54) HAIR COVER

(76) Inventor: De-Sheng Tsai, No. 140, Pao-An Street, Tai-Nan City (TW)

( * ) Notice: Subject to any disclaimer, the term of this patent is extended or adjusted under 35 U.S.C. 154(b) by 0 days.

(21) Appl. No.: 10/122,007

(22) Filed: Apr. 11, 2002

(51) Int. Cl.[7] ..... A42B 1/00
(52) U.S. Cl. ..... 2/171; 2/174; 2/202
(58) Field of Search ..... 2/171, 174, 171.04, 2/171.2, 202, 204, 200.1, 46; 34/96; 132/212, 200, 273, 274, 47, 49, 46, 79; 4/515, 520, 521; D2/865, 867–870, 878–883, 885, 886, 889, 890

(56) References Cited

U.S. PATENT DOCUMENTS 379,420 A * 3/1888 Scott ..... 2/171
811,178 A * 1/1906 Saks ..... 2/171
2,445,487 A * 7/1948 Lester et al. ..... 2/174
2,484,268 A * 10/1949 Carlson ..... 2/174
2,817,090 A * 12/1957 Toellner ..... 2/171
3,556,115 A * 1/1971 Benson ..... 2/174
4,491,985 A * 1/1985 Dalton ..... 2/171
4,887,316 A * 12/1989 Morandini ..... 2/174
5,249,308 A * 10/1993 Blume ..... 2/174
5,566,689 A * 10/1996 Yeater ..... 132/212
5,890,229 A * 4/1999 Esposito ..... 2/174
5,920,909 A * 7/1999 Ellsworth et al. ..... 2/171

* cited by examiner

*Primary Examiner*—Gloria M. Hale

(57) ABSTRACT

A hair cover is composed of a top and a bottom piece, in which the top piece further comprises a relatively longer side, an opposite relatively shorter side, and two arcuate equilateral sides; the bottom piece is correspondingly shaped to the top piece, having also a relatively longer side, a shorter side, two arcuate equilateral sides, and a central through hole. The top and the bottom piece are to be combined together by binding thermally the corresponding portions of each piece to form a trapezoid hair cover that is capable of promoting the wearing comfortableness considerably. In wearing the hair cover, one's head is put penetrating the central hole to have his hair shaded closely from his forehead and his longer hair portion shaded in a wider rear end by taking advantage of the natural stretchability of the resilient cloth of the hair cover.

2 Claims, 3 Drawing Sheets

HAIR COVER

FIELD OF THE INVENTION

This invention relates generally to hair covers, particularly to a hair cover being much convenient for production and in conformity with economic effectiveness.

BACKGROUND OF THE INVENTION

A hair cover is usually employed for holding and wrapping one's hair in order not to have it exposed to the air or some hair strings dropped off.

A conventional hair cover is mostly shaped in a circle made of nylon netting or clothing material and is fastened with an elastic band at a cover body for securing it to a wearer's head. However, such an elastic band commonly made in synthetic rubber or rubber would cost more and require stitches as a secondary processing in the first place and a wearer's head might feel uncomfortable should the band be overtight or the hair cover is liable to slip away in a second, otherwise.

As the conventional circularly shaped hair cover is undistinguishable between its front end and rear end, hence all a user has to do is just wear it irrespective of the orientation thereof and jam his/her hair inside. Under this situation, the rear space of the hair cover for receiving hair is obviously insufficient compared with the front and the lateral spaces, so that a wear's hair always looks disordered every time he/she doffs the hair cover.

SUMMARY OF THE INVENTION

The primary objective of this invention is to provide an improved hair cover composed of a top and a bottom piece, in which the top piece further comprises a relatively longer side, an opposite relatively shorter side, and two arcuate equilateral sides; the bottom piece is correspondingly shaped to the top piece, having also a relatively longer side, a shorter side, two arcuate equilateral sides, and a central through hole. The top and the bottom piece are to be combined together by binding thermally the corresponding portions of each piece to form a trapezoid hair cover.

For wearing the hair cover of this invention, a user is supposed to wear the front end (the shorter side) on his/her forehead firstly, then the rear end (the longer side) accordingly such that the long hair of the user, just in case, can be accommodated in a wide rear portion of the hair cover easily by making use of the flexibility of the resilient cloth of the hair cover.

Another objective of this invention is to provide a simple structure of hair cover, in which only two pieces of resilient cloth are required for binding thermally to form a hair cover directly without needing a secondary processing for attachment of an elastic band in order to avoid any uncomfortableness caused thereby.

And, this invention is characterized in design of a narrow front side, a wider rear side, and two arcuate lateral sides for a hair cover such that the wearing comfortableness is considerably promoted.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
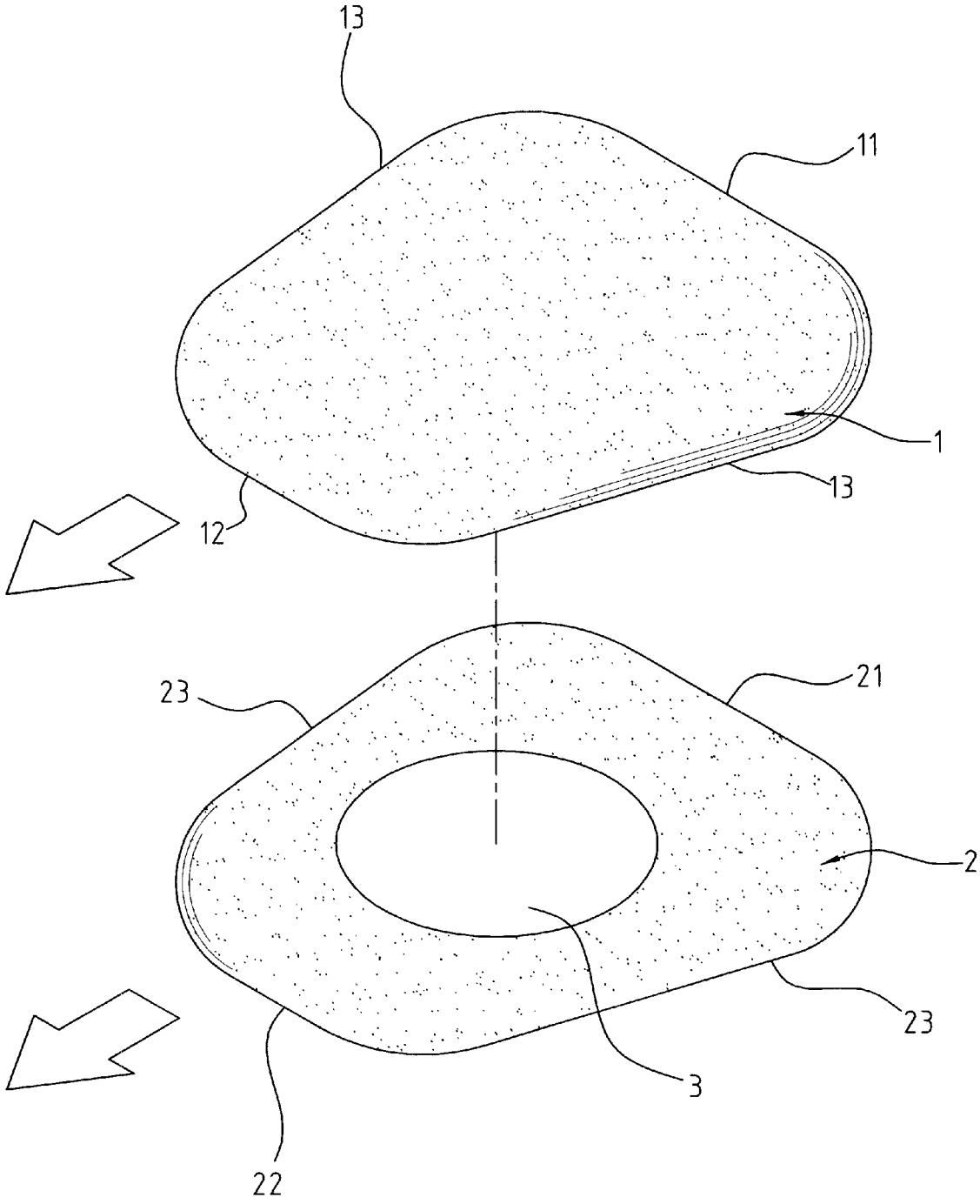
FIG. 1 is the exploded structure of this invention.

As shown in FIG. 1, a hair cover of this invention is composed of two pieces of resilient cloth, including a top piece 1 and a bottom piece 2.

The top piece 1 comprises a relatively longer side 11, an opposite relatively shorter side 12, and two arcuate equilateral sides 13. The bottom piece 2 is correspondingly shaped to the top piece 1, having also a relatively longer side 21, a shorter side 22, two arcuate equilateral sides 23, and a central through hole 3. The top and the bottom piece 1, 2 are to be combined together by binding thermally the corresponding portions of each piece to form a trapezoid, namely a narrow front end and a wider rear end, hair cover.

Figure 2:
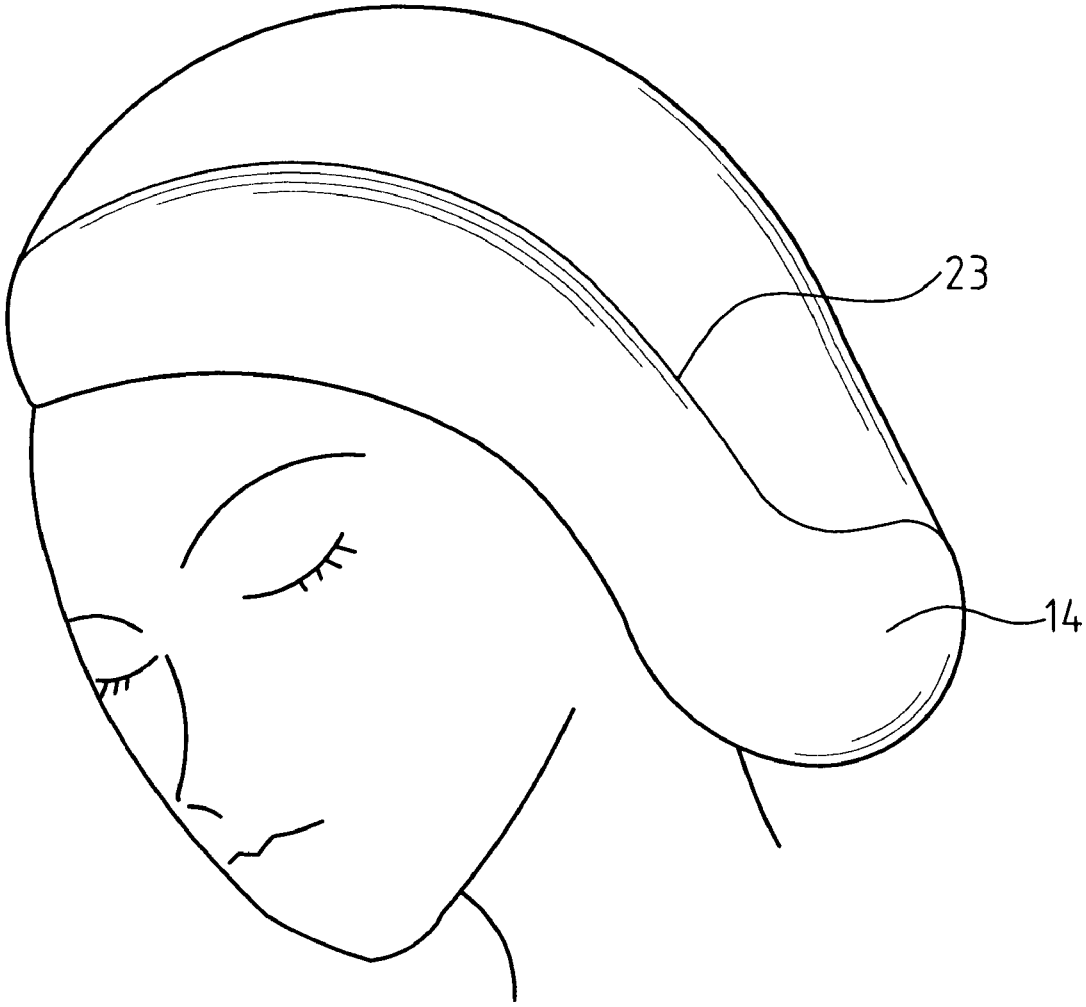
FIG. 2 is a schematic view showing that a hair cover of this invention is worn.

Referring to FIG. 2, for wearing the hair cover of this invention, a user is supposed to wear the front end (the shorter side) on his/her forehead firstly, then the rear end (the longer side) accordingly such that the long hair of the user, just in case, can be accommodated in a wide rear portion 14 of the hair cover. Moreover, because of the rich extensibility of the cloth material of the hair cover, the user's hair can be entirely wrapped and fixed on the user's head.

Figure 3:
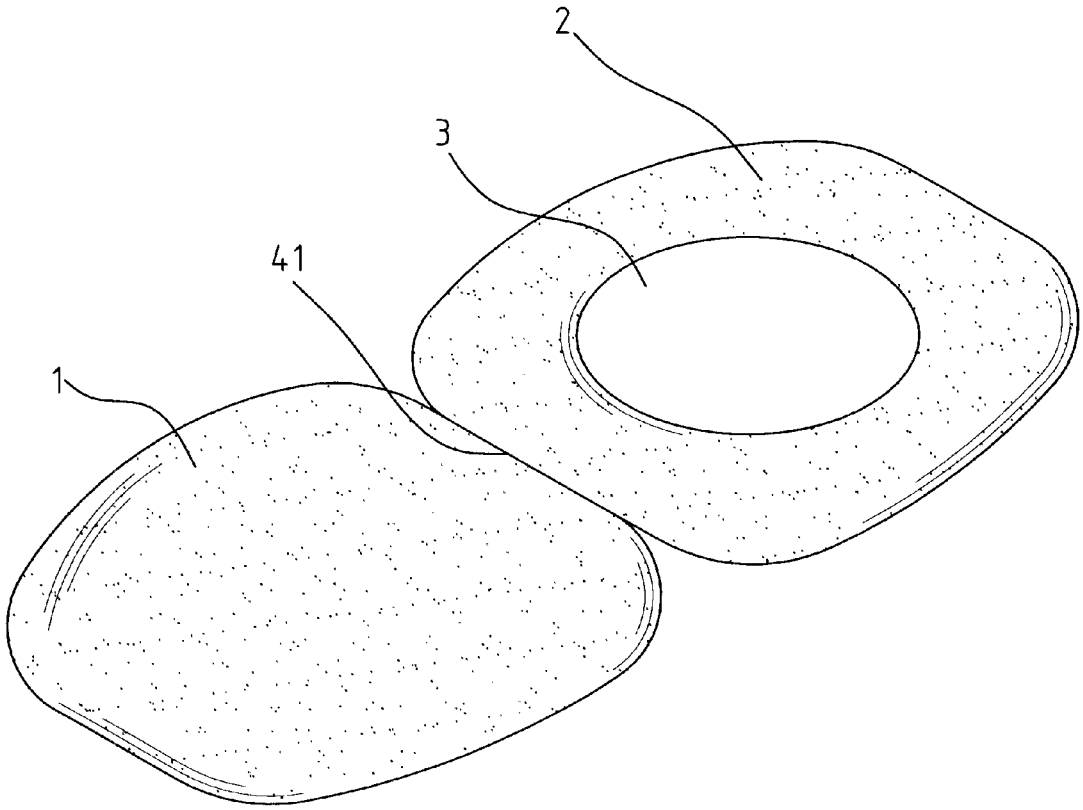
FIG. 3 shows a schematic view of another embodiment of this invention.

In another embodiment of this invention shown in FIG. 3, both the main structure and the resilient cloth used are about the same with those of the described except that the top and the bottom piece 1, 2 are punched integrally to form a unitary planar piece having a jointed common foldable portion 41 at a longer side. After the foldable portion 41 is folded and its peripheral is thermally bound correspondingly, an integral hair cover of this invention is obtained.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A hair cover, characterized in comprising a top and a bottom piece made of resilient cloth, in which said top piece further comprises a relatively longer side, an opposite relatively shorter side, and two arcuate equilateral sides; said bottom piece is correspondingly shaped to said top piece, having also a relatively longer side, a shorter side, two arcuate equilateral sides, and a central through hole; and said top piece and said bottom piece are combined together to form a trapezoid hair cover by binding the corresponding portions of each piece thermally.

2. The hair cover according to claim 1, in which said top and bottom piece are integrally punched to form a planar piece having a common foldable portion such that thermal binding can be applied to the corresponding peripheries of the piece pairs after they have been folded.

* * * * *